US008156916B2

(12) United States Patent
Burkhardt

(10) Patent No.: US 8,156,916 B2
(45) Date of Patent: Apr. 17, 2012

(54) OIL SUMP FOR USE IN INTERNAL COMBUSTION ENGINES AND TRANSMISSIONS

(75) Inventor: Wolfgang Burkhardt, Ansbach (DE)

(73) Assignee: MAN Nutzfahrzeuge AG, München (DE)

( * ) Notice: Subject to any disclaimer, the term of this patent is extended or adjusted under 35 U.S.C. 154(b) by 933 days.

(21) Appl. No.: 12/164,454

(22) Filed: Jun. 30, 2008

(65) Prior Publication Data

US 2009/0014247 A1 Jan. 15, 2009

(30) Foreign Application Priority Data

Jul. 13, 2007 (DE) ..... 10 2007 032 649

(51) Int. Cl.
*F02B 77/00* (2006.01)

(52) U.S. Cl. ..... 123/195 C; 123/198 E; 184/6.5; 184/6.6; 220/660

(58) Field of Classification Search ..... 123/195 C, 123/198 E; 184/6.5, 6.6; 29/890.09
See application file for complete search history.

(56) References Cited

U.S. PATENT DOCUMENTS 2,837,063 A * 6/1958 Martinez ..... 403/288
3,678,914 A * 7/1972 Vulliamy ..... 123/195 C
4,619,343 A 10/1986 Lengenfelder
4,667,628 A * 5/1987 Lopez-Crevillen ..... 123/195 C
4,682,672 A * 7/1987 Berger et al. ..... 184/106
7,069,899 B1 * 7/2006 Okuda et al. ..... 123/195 C
7,195,131 B2 * 3/2007 Bryant ..... 220/325
7,597,083 B1 * 10/2009 Nachtman ..... 123/195 C
2003/0037743 A1 * 2/2003 Salameh ..... 123/90.38
2003/0037756 A1 * 2/2003 Salameh ..... 123/195 C
2006/0255547 A1 * 11/2006 Widder ..... 277/592
2007/0181090 A1 * 8/2007 Jeanne ..... 123/195 C

FOREIGN PATENT DOCUMENTS

DE 3418717 11/1985
DE 8801471 U1 3/1988
DE 3929592 A1 3/1991
JP 53115427 7/1978
JP 11036838 9/1989
JP 9184413 7/1997

* cited by examiner

*Primary Examiner* — Marguerite McMahon
*Assistant Examiner* — Grant Moubry
(74) *Attorney, Agent, or Firm* — Cozen O'Connor

(57) ABSTRACT

An oil sump for use in internal combustion engines or transmissions, where the oil sump consists of sheet metal shaped by deep drawing and has a reinforced edge, by means of which it rests, in its mounted state, in the internal combustion engine or the transmission with a seal positioned between them. The reinforcement consists of at least one separate metal part, which is mounted on the edge of the oil sump by positive locking and/or nonpositive locking with deformation of the edge of the oil sump.

5 Claims, 1 Drawing Sheet

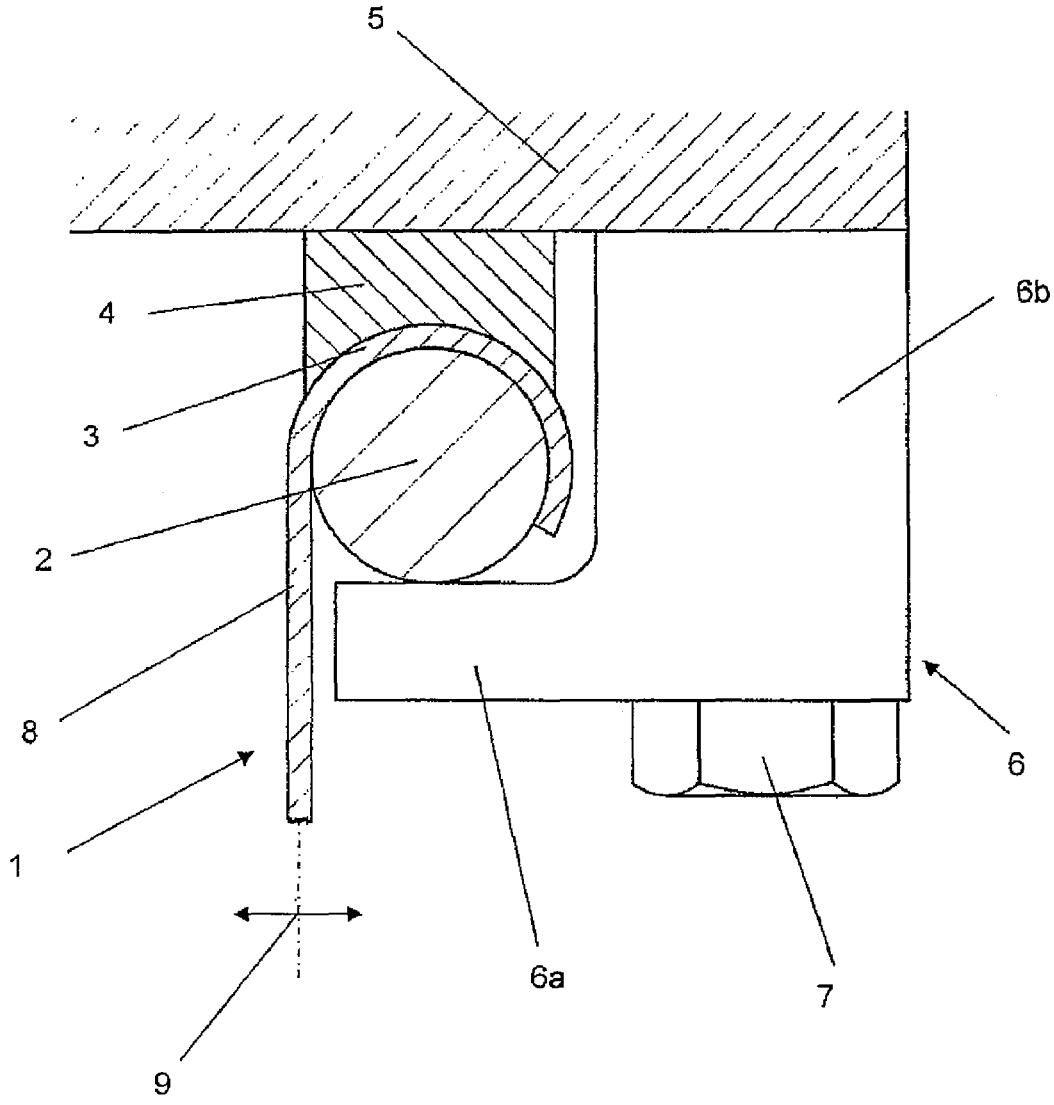
5
4
3
2
8
1
9
6b
6
6a
7

OIL SUMP FOR USE IN INTERNAL COMBUSTION ENGINES AND TRANSMISSIONS

BACKGROUND OF THE INVENTION

1. Field of the Invention

The present invention is directed to an oil sump for use in internal combustion engines or transmissions and particularly an oil sump made of sheet metal having a reinforced peripheral area for mounting the same to the combustion engine or transmission.

2. Description of the Related Art

Internal combustion engines, both those built into motor vehicles and those operated on a stationary basis, usually have an oil sump, which is installed in the crankcase near the crankshaft and encloses the crankshaft. Oil sumps of this type are also used in transmissions. It is also customary to provide sump covers for such oil sumps for purposes of sound insulation. Sump covers of this type are often produced from steel sheet, which is formed into a cover by the deep-drawing process.

Oil sumps of this type are subjected to very large forces of acceleration due to the vibrations of the internal combustion engine or of the motor vehicle if the internal combustion engine is being operated in a motor vehicle. For example, accelerations of up to 50 times the acceleration of gravity have been measured in oil sumps of commercial vehicles. As a result, special design measures must be taken, especially in the area of the mounting of the sump to the internal combustion engine, to prevent cracking in this area of the sumps and to guarantee reliable sealing from the crankcase. The same applies to oil sumps in transmissions.

In this connection, DE 88 01 471 U1 discloses the provision of reinforcing seams on the edge of the sump bent in the form a flange, where the through holes for mounting bolts for mounting the oil sump to the crankcase are located between the peripheral reinforcing seams, and the oil sump is mounted to the crankcase with a seal placed between them. One disadvantage of this arrangement is that the mounting bolts, which make point contact, are conducive to crack formation, so that sufficiently strong vibrations of the oil sump lead to cracking. Another disadvantage is that the mounting bolts, which make point contact, cause deflection of the flange between the mounting points due to the elasticity of the material, so that the oil sump is pressed against the crankcase with highly variable forces over the length of the flange.

In addition, DE 39 29 592 A1 discloses the mounting of a deep-drawn sheet-metal oil sump by bolts on a flange of the crankcase with the interposition of a shaped intermediate piece or bridge in order to increase the flexural strength of the oil sump flange. The problem with this arrangement is that, due to the relatively high manufacturing tolerances that occur in the deep drawing of the oil sump, shaped bridges have very large dimensional deviations from the oil sump, if they are to stiffen the entire peripheral flange of the oil sump, i.e., are manufactured as a single piece or in several relatively long sections. On the one hand, this causes big problems with respect to mounting, and, on the other hand, there is an uneven distribution of the contact forces of the shaped bridge on the flange and, consequently, an increased tendency to cracking in the areas of the oil sump that are acted upon by higher contact pressure. Moreover, uneven contact of the flange of the oil sump on the crankcase flange can have a negative effect on the seal between them.

Finally, it is known from DE 34 27 529 A1 (U.S. Pat. No. 4,619,343) that the oil sump and the crankcase can be joined by means of spring clips.

SUMMARY OF THE INVENTION

An objective of the present invention is to avoid the disadvantages of the prior art described above by constructing an oil sump produced by the deep drawing of sheet metal with a peripheral area or edge reinforced by an insert in the flange in such a way that the oil sump can be mounted to an internal combustion engine without the use of through holes and that dimensional deviations between the oil sump and the peripheral edge reinforcement during mounting do not occur. A further objective of the invention is a method for manufacturing an oil sump of this type.

An objective with respect to the oil sump itself is achieved by providing an oil sump of sheet metal shaped by deep drawing and having a reinforced peripheral area or edge, by means of which it rests, in its mounted state, on the internal combustion engine or the transmission with a seal positioned between them. The reinforcement is formed of at least one separate metal part, which is mounted on the peripheral area or edge of the oil sump by a form fit or positive locking and/or by a force fit or nonpositive locking with deformation of the peripheral area or edge of the oil sump. Advantageously, the metal part has a circular shape, at least in some of the areas that are not immediately adjacent to the oil sump, in such a way that the oil sump, with linear contact of the mounting device on the circularly formed areas, can be clamped to the internal combustion engine or the transmission with the interposition of sealing means. More advantageously, the metal part has a circular cross section, and is made from bent rod steel and the oil sump made from of steel sheet. The metal part may also be a cast shaped part. Also provided is a method for producing an oil sump for use in internal combustion engines or transmissions, where the oil sump is made of sheet metal shaped by deep drawing and has a reinforced peripheral area or edge, by means of which it rests, in its mounted state, on the internal combustion engine or the transmission with a seal positioned between them. According to the method of the present invention, the oil sump is first preshaped from sheet metal in one or more deep-drawing operations. At least one metal part is produced in a shaping production process in an operation that is separate from the above deep-drawing operations. The metal part is shaped in such a way that its shape corresponds to at least part of the final shape of the peripheral area or edge of the oil sump. The metal part and the preshaped oil sump are then placed in a die and, in an additional shaping process, the peripheral area or edge of the oil sump is shaped around the metal part so that a nonpositive connection or a positive connection, i.e. a form fit or force fit connection, is produced between the oil sump and the metal part. Advantageously, the nonpositive connection or the positive connection between the metal part and the oil sump is produced in an additional deep-drawing step. Preferably, the nonpositive connection or the positive connection between the metal part and the oil sump is produced by flanging the peripheral area or edge of the oil sump around the metal part. Advantageously, the shaping production process for producing the metal part is a bending process or a casting process.

The invention starts with an oil sump for use in internal combustion engines or transmissions, where the oil sump is made of sheet metal shaped by deep drawing and has a reinforced peripheral area or edge, by means of which it rests, in its mounted state, on the internal combustion engine or the transmission with a seal positioned between them. To avoid cracking in the area of the edge of the oil sump, it has been found to be effective to produce the reinforcement with at least one separate metal part, which is mounted on the edge of the oil sump by positive locking and/or nonpositive locking, i.e. form fit and/or force fit with deformation of the peripheral area or edge of the oil sump. These measures make it possible to avoid the otherwise unavoidable dimensional deviations between the oil sump and the metal part.

By making the metal part circular or round shaped at least in some of the areas that are not immediately adjacent to the oil sump, it is possible to ensure that the oil sump, with linear contact of mounting devices on the circularly formed areas, can be clamped to the internal combustion engine or the transmission with the interposition of sealing means. The linear contact on the mounting devices ensures that bending movements of the wall of the oil sump relative to the mounting can occur to a certain extent without appreciable bending stresses arising in the wall of the oil sump. This measure has the advantage that cracking due to bending stresses in the area of the edge of the sump can be avoided.

The metal part can be incorporated in the peripheral area or edge of the oil sump in an especially simple and thus advantageous way if the metal part has a round cross section. Preferably, the cross-section of the metal part is circular. Especially well suited in this connection is curved rod steel in combination with an oil sump made of steel sheet.

In the case of complicated shapes of the peripheral area or edge of the oil sump, it is advantageous to incorporate a cast metal part in the edge of the oil sump, which consists, e.g., of steel sheet.

As pointed out above, it is advantageous for the oil sump of the present invention for use in internal combustion engines or transmissions to be fabricated in such a way that the oil sump is first preshaped from sheet metal in one or more deep-drawing operations. In an operation that is separate from these deep-drawing operations, at least one metal part is produced in a shaping production process, where the metal part is shaped in such a way that its shape corresponds to at least part of the final shape of the outer peripheral area of the oil sump. The metal part and the preshaped oil sump are then placed in a die and subjected to an additional shaping process, in which the outer peripheral area of the oil sump is shaped around the metal part in such a way that a nonpositive (force fit) connection or a positive (form fit) connection is produced between the oil sump and the metal part. In this regard, the aforesaid additional shaping process can be another deep-drawing step, but it is also possible to join the metal part and the oil sump by flanging the outer peripheral area of the oil sump around the metal part.

Various shaping processes can be used to produce the metal part for reinforcing the outer peripheral area of the oil sump. The simplest and thus the most advantageous method is to produce the metal part by bending, e.g., a round rod, or by using a metal casting process.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWING

An example of a preferred embodiment of the present invention is described in greater detail below with reference to the attached drawing which shows a simplified partial view of a cross section perpendicular to the peripheral area or edge of the oil sump of the present invention.

DETAILED DESCRIPTION OF THE PRESENTLY PREFERRED EMBODIMENT

The drawing is a schematic, cross-sectional view of an oil sump for an internal combustion engine of a commercial vehicle. A metal part 2, rod steel in the present example, is incorporated by positive joining in the oil sump 1, which consists of steel sheet. On the side of the peripheral area 3 of the oil sump that faces away from the metal part 2, there is an elastic seal 4 that extends along the peripheral area or edge 3 of the oil sump and that is disposed between the crankcase 5 and the peripheral area 3 of the oil sump when the oil sump 1 rests against the crankcase 5.

To mount the oil sump 1 on the crankcase 5, an L-shaped bracket 6 is provided as the mounting device. The first leg **6*a* of the bracket rests against the metal part 2, tangentially in the drawing but linearly as viewed perpendicularly to the plane of the drawing. The bracket or mount 6 is mounted on the crankcase 5 by a through bolt 7, which passes through the second leg 6*b*** and is anchored in the crankcase by means of a threaded bore (not shown).

On the one hand, the arrangement illustrated here prevents the occurrence of dimensional deviations between the peripheral area or edge 3 of the oil sump and the metal part 2 during the installation of the oil sump 1 due to the incorporation of the metal part 2 in the edge 3 of the oil sump. On the other hand, a nonpositive or force fit connection between the peripheral area or edge 3 of the oil sump and the metal part 2 prevents the occurrence of fretting corrosion between these parts. The linear contact of the metal part 2 on the bracket 6 ensures that the wall 8 of the oil sump can vibrate in the direction of the arrows 9, i.e., in the form of bending movements, without unacceptably high bending stresses arising in the peripheral area 3 or the wall 8 of the oil sump. Generally speaking, this is a result of the round free side of the metal part 2 that faces the first leg **6*a* of the bracket 6 and that can thus roll on the surface of the leg 6*a*. The elastic seal 4 offers no appreciable resistance to this movement on the side of the oil sump 1 that faces the crankcase 5**.

Naturally, with respect to the metal part 2, in the present example, a rod with circular cross-section incorporated in the peripheral area of the oil sump, other cross-sectional shapes are also possible; it is only necessary to maintain round or ball-like cross-sectional shape of the side that faces the free leg **6*a*** of the bracket.

Of course, in addition to the above-described combination of an oil sump made of steel sheet and rod steel as reinforcement for the peripheral area or edge of the oil sump, other combinations of materials are possible; for example, the incorporated metal part can also be cast iron or cast aluminum. The material which is used depends on the particular structural circumstances.

Naturally, in addition to the application described in the above example as an oil sump for an internal combustion engine built into a commercial vehicle, the arrangement can also be used for other applications, in which strong vibrations arise in sumps, e.g., as an oil sump for a transmission in a commercial vehicle or as sump covers for the aforesaid oil sumps.

The oil sump 1 is preferably fabricated from sheet metal in several deep-drawing operations by first preshaping the oil sump 1 itself in several steps. Deep-drawing processes are already sufficiently well known to those skilled in the art, so there is no need for a detailed description of these processes here. In a separate operation from these deep-drawing operations, the metal part 2 is produced in a shaping production process. For the oil sump described above, this means that the rod steel is bent in such a way that it corresponds to the final peripheral area or edge 3 of the oil sump. The metal part 2 and the preshaped oil sump 1 are thus fastened together. In an additional shaping process, the peripheral area 3 of the oil sump is then shaped around the fixed metal part 2 in such a way that, as shown in the drawing, a nonpositive connection or a positive connection is formed between the oil sump 1 and the metal part 2. In this regard, the aforesaid additional shaping process can be another deep-drawing step, but it is also possible to join the metal part 2 and the oil sump 1 by flanging the peripheral area or edge 3 of the oil sump around the metal part 2.

The invention is not limited by the embodiments described above which are presented as examples only but can be modified in various ways within the scope of protection defined by the appended patent claims.

What is claimed:

1. An oil sump for use in at least one of internal combustion engines and transmissions, comprising:

a wall made of sheet metal shaped by deep drawing and having a reinforced edge for resting in its mounted state on the one of the internal combustion engine and the transmission; and at least one separate metal part mounted on said edge of the oil sump by one of positive locking and nonpositive locking with deformation of the edge of the oil sump, wherein said metal part has a circular cross section.

2. The oil sump of claim 1, additionally comprising a seal interposed between said sheet metal and a crankcase.

3. The oil sump in accordance with claim 1, additionally comprising a mount and wherein said metal part has a round cross-section at least in an area which is not immediately adjacent the oil sump, so that the oil sump, with linear contact of mount on the round cross-section of said metal part can be clamped to the internal combustion engine or the transmission.

4. The oil sump in accordance with claim 1, wherein said metal part is bent rod steel and the oil sump wall is made of steel sheet.

5. The oil sump in accordance with claim 1, wherein said metal part is a cast shaped part and the oil sump wall is made of steel sheet.

* * * * *